US007782174B2

(12) United States Patent
Urano

(10) Patent No.: US 7,782,174 B2
(45) Date of Patent: Aug. 24, 2010

(54) CHIP RESISTOR

(75) Inventor: Koichi Urano, Nagano (JP)

(73) Assignee: KOA Corporation, Ina-shi (JP)

( * ) Notice: Subject to any disclaimer, the term of this patent is extended or adjusted under 35 U.S.C. 154(b) by 364 days.

(21) Appl. No.: 12/066,844

(22) PCT Filed: Sep. 15, 2006

(86) PCT No.: PCT/JP2006/318422

§ 371 (c)(1),
(2), (4) Date: Mar. 14, 2008

(87) PCT Pub. No.: WO2007/034759

PCT Pub. Date: Mar. 29, 2007

(65) Prior Publication Data

US 2009/0115569 A1 May 7, 2009

(30) Foreign Application Priority Data

Sep. 21, 2005 (JP) ..... 2005-274223

(51) Int. Cl.
*H01C 1/012* (2006.01)

(52) U.S. Cl. ..... 338/309; 338/307

(58) Field of Classification Search ..... 338/307–309, 338/332, 313

See application file for complete search history.

(56) References Cited

U.S. PATENT DOCUMENTS 5,680,092 A * 10/1997 Yamada et al. ..... 338/309
5,907,274 A 5/1999 Kimura et al.
6,314,637 B1 11/2001 Kimura et al.
6,492,896 B2 * 12/2002 Yoneda ..... 338/309
6,982,624 B2 * 1/2006 Saito et al. ..... 338/309

FOREIGN PATENT DOCUMENTS

JP 4-102302 A 3/1992
JP 10-144501 A 5/1998
JP 2000-58303 A 2/2000
JP 2003-264101 A 9/2003
JP 2003-282303 A 10/2003
JP 2003-282305 A 10/2003

OTHER PUBLICATIONS

International Search Report dated Dec. 19, 2006 with an English translation of the pertinent portions (Four (4) pages).

* cited by examiner

*Primary Examiner*—Kyung Lee
(74) *Attorney, Agent, or Firm*—Crowell & Moring LLP

(57) ABSTRACT

Disclosed is a chip resistor 1 that includes a ceramic substrate 2, a pair of bank-raising foundation sections 3 positioned on both longitudinal ends of the lower surface of the ceramic substrate 2, a pair of first electrode layers 4 that cover at least parts of the bank-raising foundation sections 3 and are positioned at a predetermined distance from each other, a resistive element 5 that is made mainly of a copper-nickel alloy to bridge the first electrode layers 4, a pair of second electrode layers 6 that cover the pair of first electrode layers 4, and an insulating protective layer 7 that covers the resistive element 5. Further, end-face electrodes 9 are positioned on both longitudinal end faces of the ceramic substrate 2. The second electrode layers 6 and end-face electrodes 9 are covered with plating layers 10-13. This chip resistor 1 is to be face-down mounted with the first and second electrodes 4, 6 positioned on a wiring pattern 21 of a circuit board 20.

2 Claims, 4 Drawing Sheets

CHIP RESISTOR

TECHNICAL FIELD

The present invention relates to a low-resistance chip resistor that is used, for instance, for current detection in an electronic circuit, and more particularly to a low-resistance chip resistor that is to be face-down mounted.

BACKGROUND ART

A common chip resistor is made by providing the upper surface of a ceramic substrate with a pair of upper electrodes, a resistive element for bridging the upper electrodes, and a protective layer for covering the resistive element, providing the lower surface of the ceramic substrate with a pair of lower electrodes, and providing both longitudinal end faces of the ceramic substrate with an end-face electrode. The end-face electrode is closely attached to the upper and lower electrodes. Each of these electrodes is covered with a plating layer. When the chip resistor is to be mounted, the lower electrodes are positioned on a wiring pattern of a circuit board, and then the wiring pattern is soldered to the plating layer so that electrical power is distributed to the upper electrodes and resistive element through the end-face electrode.

Meanwhile, the resistive element for the above type of chip resistor is often made of a ruthenium oxide material. For a chip resistor that is used, for instance, for electronic circuit current detection, however, it is necessary that its resistance be not higher than 1Ω. Under such circumstances, a low-resistance chip resistor that uses a resistive element made mainly of copper has long been known (refer, for instance, to Patent Document 1). Copper is a low-resistance material and has a small temperature coefficient of resistance (TCR). Therefore, when the resistive element is made mainly of copper, it is possible to obtain a low-resistance, low-TCR chip resistor having a resistance value setting of not higher than 1Ω.

However, even when a resistive element made of a low-resistance material is positioned on the upper surface of the ceramic substrate, the resistive element is electrically connected to the wiring pattern on the circuit board through the end-face electrode. Therefore, when an attempt is made to lower the resistance of the chip resistor, the inductance of the end-face electrode cannot be ignored. When the chip resistor is mounted on the wiring pattern of the circuit board, power is distributed to the upper electrodes and resistive element through the end-face electrode. However, the end-face electrode is extended from the lower end of the ceramic substrate to the upper end. Therefore, a resistance value that would inhibit the chip resistor from lowering its resistance is unavoidably generated by the end-face electrode.

Under the above circumstances, the inventor has focused its attention on face-down mounting, that is, mounting the resistive element side of the chip resistor on the component side of the circuit board, as a method for lowering the resistance of the chip resistor. When the resistive element and its electrode section are positioned on the lower surface of the ceramic substrate of the chip resistor with the electrode section placed on the wiring pattern of the circuit board, power can be distributed to the resistive element while bypassing the end-face electrode. Therefore, the resistive element could be made mainly, for instance, of a copper-nickel alloy to readily lower the resistance of the chip resistor. The face-down mounting technique described above has long been used for the purpose, for instance, of downsizing the chip resistor (refer, for instance, to Patent Document 2).

Patent Document 1: Japanese Patent Application Laid-Open Publication No. H10-144501 (pages 4 and 5, FIG. 1)

Patent Document 2: Japanese Patent Application Laid-Open Publication No. 2000-58303 (page 2, FIG. 9)

DISCLOSURE OF THE INVENTION

Problem to be Solved by the Invention

As described above, the resistance of the chip resistor can be lowered when the chip resistor is face-down mounted with a low-resistance resistive element positioned on the lower surface of the ceramic substrate of the chip resistor. However, the highly conductive electrode section to be positioned on both ends of the resistive element has to be made slightly thinner, for instance, by screen printing than the film of the resistive element. Therefore, it is likely that the protective layer, which covers the resistive element on the lower surface of the chip resistor, may be positioned at substantially the same height as the plating layer, which covers the electrode section. If the protective layer of the chip resistor protrudes downward from the plating layer, it is likely that the chip resistor may be inclined when mounted on the circuit board. This increases the probability of mounting failure. Further, when the electrode section positioned on both ends of the resistive element has a small film thickness, a great inductance results. This may also inhibit the chip resistor from lowering its resistance.

The present invention has been made in view of the conventional technologies described above. An object of the present invention is to provide a chip resistor that is unlikely to suffer from mounting failure and capable of readily lowering its resistance.

Means for Solving the Problem

In accomplishing the above object, according to one aspect of the present invention, there is provided a chip resistor including: a ceramic substrate shaped like a rectangular parallelepiped; a pair of bank-raising foundation sections that are made mainly of glass and positioned on both longitudinal ends of the lower surface of the ceramic substrate; a pair of first electrode layers that are provided in regions covering at least parts of the bank-raising foundation sections and positioned at a predetermined distance from each other; a resistive element that is made mainly of copper and positioned in a region bridging the first electrode layers; a pair of second electrode layers that are positioned in regions covering the first electrode layers; an insulating protective layer that covers the resistive element exposed between the second electrode layers; a pair of end-face electrodes that are positioned on both longitudinal end faces of the ceramic substrate with the lower ends closely attached to the second electrode layers; and a plating layer that covers the second electrode layers and the end-face electrodes; wherein the plating layer is soldered to a wiring pattern on a circuit board with the first and second electrode layers positioned on the wiring pattern to mount the chip resistor on the circuit board.

The chip resistor configured as described above has a resistive element made of a low-resistance, low-TCR material. Further, when it is face-down mounted, it can distribute power to the resistive element while bypassing the end-face electrodes. Furthermore, the electrode section of the resistive element includes two layers, that is, the first and second electrode layers, to provide increased film thickness. Therefore, an extremely small inductance setting can be employed for the electrode section. Consequently, the chip resistor can readily lower its resistance and improve TCR characteristics. In addition, a two-layer structure, which includes the first and second electrode layers, is provided for the chip resistor to cover the bank-raising foundation sections, which are attached to the lower surface of the ceramic substrate. Therefore, parts of the second electrode layers protrude downward by an amount corresponding to the film thickness of the bank-raising foundation sections. Consequently, the outermost layer of the plating layer covering the second electrode layers can easily be shaped as desired so that it protrudes downward from the protective layer covering the resistive element. As a result, it is unlikely that the chip resistor will be inclined when mounted on the circuit board. This decreases the probability of mounting failure. Although the end-face electrodes of the chip resistor do not constitute an electrical contribution, they create a solder fillet when they are mounted on and soldered to the wiring pattern of the circuit board. Therefore, the end-face electrodes considerably increase the mounting strength prevailing after mounting.

According to another aspect of the present invention, there is provided the chip resistor as described in the above aspect, wherein the second electrode layers are larger than the first electrode layers and parts of the second electrode layers are closely attached to the lower surface of the ceramic substrate. In this instance, the first electrode layers and second electrode layers, which are included in the two-layer structure, are both closely attached to the ceramic substrate. This makes it possible to properly prevent the electrode layers from separating from each other, thereby providing increased reliability.

EFFECTS OF THE INVENTION

The chip resistor according to the present invention has the first and second electrode layers, which are formed over the bank-raising foundation sections on the lower surface of the ceramic substrate. Therefore, the outermost layer of the plating layer covering the second electrode layers can easily protrude downward from the protective layer covering the resistive element. As a result, it is unlikely that the chip resistor will be inclined when mounted on the circuit board. This decreases the probability of mounting failure. Further, the chip resistor has a resistive element made of a low-resistance, low-TCR material. Further, when it is face-down mounted, it can distribute power to the resistive element while bypassing the end-face electrodes. Furthermore, the electrode section (which includes the first and second electrode layers) for the resistive element has a two-layer structure and accepts an extremely small inductance setting. Therefore, the chip resistor can readily lower its resistance and improve TCR characteristics. In addition, when the chip resistor is mounted on a circuit board, the end-face electrodes create a solder fillet. This makes it easy to obtain required mounting strength.

BEST MODE FOR CARRYING OUT THE INVENTION

Embodiments of the present invention will now be described with reference to the accompanying drawings. FIG. 1 is a cross-sectional schematic view illustrating a chip resistor according to an embodiment of the present invention. FIG. 2 is a cross-sectional view illustrating a manufacturing process for the chip resistor. FIG. 3 is a plan view illustrating a manufacturing process for the chip resistor. FIG. 4 is a cross-sectional view illustrating an essential part of the chip resistor mounted on a circuit board.

The chip resistor 1 shown in the above figures is of a low-resistance, low-TCR type and is to be face-down mounted on a circuit board 20. This chip resistor 1 includes a ceramic substrate 2 that is shaped like a rectangular parallelepiped. Mounted on the lower surface of the ceramic substrate 2 are a pair of bank-raising foundation sections 3 that are made mainly of glass, a pair of trapezoidal first electrode layers 4 that cover parts of the bank-raising foundation sections 3; a resistive element 5 that is made mainly of a copper-nickel alloy and used to bridge the pair of first electrode layers 4; a pair of square-shaped second electrode layers 6 that cover the first electrode layers 4; and an insulating protective layer 7 that covers the resistive element 5 that is exposed without being covered by first and second electrode layers 4, 6. The chip resistor 1 also includes a pair of upper electrodes 8, which are positioned on both longitudinal ends of the upper surface of the ceramic substrate 2. End-face electrodes 9 bridge the first and second electrode layers 4, 6 and upper electrodes 8 that are in the corresponding positions. Further, the second electrode layers 6, upper electrodes 8, and end-face electrodes 9 are covered by four plating layers 10-13.

The ceramic substrate 2 is an alumina substrate, which is one of a large number of substrates obtained by cutting a large-size substrate (not shown) vertically and horizontally. The pair of bank-raising foundation sections 3 are strips that are positioned on both longitudinal ends of the lower surface of the ceramic substrate 2. The pair of first electrode layers 4 are positioned at a predetermined distance from each other, and the side having a relatively narrow width overlaps the bank-raising foundation sections 3. The resistive element 5 is positioned at the center of the lower surface of the ceramic substrate 2. Both ends of the resistive element 5 overlap the wider end of each first electrode layer 4. The distance between the pair of second electrode layers 6 is equal to the distance between the pair of first electrode layers 4. However, since the second electrode layers 6 are larger than the first electrode layers 4, a part of each second electrode layer 6 is closely attached to the lower surface of the ceramic substrate 2. The first and second electrode layers 4, 6 are both made of a copper-based (or silver-based) highly conductive material and equal in film thickness. The protective layer 7 is made of insulating resin such as epoxy-based resin. Both ends of the protective layer 7 overlap each second electrode layer 6. Although the pair of upper electrodes 8 and the pair of end-face electrodes 9 do not actually function as electrodes, they serve as a foundation layer for the plating layers 10-13, thereby contributing toward solder connection strength enhancement. The upper electrodes 8 are made of a copper-based (or silver-based) highly conductive material, whereas the end-face electrodes 9 are made of a nickel-chrome-based highly conductive material. As shown in FIG. 4, the lower ends of the end-face electrodes 9 are closely attached to the first and second electrode layers 4, 6, and the upper ends of the end-face electrodes 9 are closely attached to the upper electrodes 8. The innermost layer of the four plating layers 10-13 is a nickel-plating layer 10. The second innermost layer is a copper-plating layer 11. The third innermost layer is a nickel-plating layer 12. The outermost layer is a tin-plating layer 13. A marking layer 14, which is made of insulating resin, is printed on the center of the upper surface of the ceramic substrate 2.

The manufacturing process for the chip resistor 1, which is configured as described above, will now be described mainly with reference to FIGS. 2 and 3. These figures show only one chip area. In reality, however, a large number of chip resistors are simultaneously manufactured. Therefore, a large-size, multi-chip substrate (not shown) is provided with a large number of chip areas. Substrate strips (not shown), which are obtained by dividing the large-size substrate into strips, are provided with a plurality of chip areas.

First of all, glass-based paste is printed onto one surface of a large-size, multi-chip substrate (the lower surface of the ceramic substrate 2) and baked to form strip-shaped bank-raising foundation sections 3 on both longitudinal ends of each chip area (the area enclosed by a two-dot chain line in FIG. 3), as shown in FIGS. 2(*a*) and 3(*a*). Next, as shown in FIG. 2(*b*), copper-based (or silver-based) conductive paste is printed onto the other surface of the large-size substrate (the upper surface of the ceramic substrate 2) and baked to form the upper electrodes 8 on both longitudinal ends of each chip area. However, the bank-raising foundation sections 3 and upper electrodes 8 may alternatively be formed in reverse order.

Next, as shown in FIGS. 2(*c*) and 3(*b*), copper-based (or silver-based) conductive paste is printed onto the one surface of the large-size substrate and baked to form in each chip area the trapezoidal first electrode layers 4 that overlap the bank-raising foundation sections 3. Subsequently, as shown in FIGS. 2(*d*) and 3(*c*), conductive past made mainly of a copper-nickel alloy is printed onto the one surface of the large-size substrate and baked to form in each chip area the resistive element 5 that bridges the pair of first electrode layers 4.

Next, as shown in FIGS. 2(*e*) and 3(*d*), copper-based (or silver-based) conductive paste is printed onto an area covering each first electrode layer 4 on the one surface of the large-size substrate and baked to form square-shaped second electrode layers 6, which are larger than the first electrode layers 4. Since the first and second electrode layers 4, 6 are printed to keep them from overlapping the peripheral border of each chip area, they are not likely to enter a break groove for dividing the large-size substrate. Therefore, even when the electrode layers are made of a highly ductile material containing copper, burrs are not likely to arise. This makes it possible to smoothly perform a primary division procedure for the large-size substrate, thereby providing increased manufacturing yield. Next, as shown in FIGS. 2(*f*) and 3(*e*), a trimming groove 5*a* is formed in the resistive element 5 with a laser or the like to adjust the resistance value with a resistance measurement probe (not shown) brought into contact with the pair of second electrode layers 6 in each chip area.

Next, as shown in FIGS. 2(*g*) and 3(*f*), epoxy-based resin paste is printed to cover the resistive element 5 exposed between the pair of second electrode layers 6 in each chip area and heat-hardened to form the insulating protective layer 7 that crosses each chip area. Further, the same resin paste as for the protective layer 7 is printed onto the opposite surface of the large-size substrate and heat-hardened to form the marking layer 14 in each chip area.

Next, the large-size substrate is divided into strips along a primary division break groove. Nickel chrome is then sputtered onto the exposed division surfaces of each substrate strip to form the end-face electrodes 9 whose both ends are closely attached to the first and second electrode layers 4, 6 and upper electrodes 8 as shown in FIGS. 2(*h*) and 3(*g*).

Subsequently, the substrate strips are divided into individual pieces along a secondary division break groove. The individual pieces are then sequentially subjected to electrolytic plating to form the four plating layers 10-13 as shown in FIGS. 1 and 3(*h*). The chip resistor 1 is now completed. The electrolytic plating process is performed by covering the second electrode layers 6, upper electrodes 8, and end-face electrodes 9 with a nickel-plating layer 10, covering the nickel-plating layer 10 with a copper-plating layer 11, covering the copper-plating layer 11 with a nickel-plating layer 12, and finally covering the nickel-plating layer 12 with a tin-plating layer 13. These plating layers 10-13 prevent electrode breakage and provide enhanced reliability. At least two plating layers are required. It is not always necessary to provide four plating layers.

The chip resistor 1 manufactured as described above is face-down mounted with the first and second electrode layers 4, 6 placed on the wiring pattern 21 of the circuit board 20. Therefore, the protective layer 7, which covers the resistive element 5, faces the component side of the circuit board 20, and the tin-plating layer 13, which is the outermost layer of the chip resistor 1, is connected with solder 22 to a solder land 21*a* of the wiring pattern 21 to establish an electrical and mechanical connection. In this instance, the end-face electrodes 9, which are erect above the solder land 21*a*, form a solder fillet 22*a*. This sufficiently increases the mounting strength of the chip resistor 1 relative to the circuit board 20, thereby providing adequate reliability.

As described above, the chip resistor 1 according to the present embodiment includes a low-resistance, low-TCR resistive element 12. Further, when face-down mounted, this chip resistor 1 can distribute power to the resistive element 5 while bypassing the end-face electrodes 9. Furthermore, the electrode section for the resistive element 5 has a two-layer structure, which includes the first and second electrode layers 4, 6, to provide increased film thickness. Therefore, an extremely small inductance setting can be employed for the electrode section. Consequently, the chip resistor 1 can readily lower its resistance and improve TCR characteristics.

In addition, the two-layer structure, which includes the first and second electrode layers 4, 6, is provided for the chip resistor 1 to cover the bank-raising foundation sections 3, which are attached to the lower surface of the ceramic substrate 2. Therefore, parts of the second electrode layers 6 protrude downward by an amount corresponding to the film thickness of the bank-raising foundation sections 3. Consequently, the outermost layer (tin-plating layer 13) of the plating layer covering the second electrode layers 6 can easily be shaped as desired so that it protrudes downward from the protective layer 7 covering the resistive element 5. As a result, it is unlikely that the chip resistor 1 will be inclined when mounted on the circuit board 20. This decreases the probability of mounting failure.

According to the present embodiment, the first electrode layers 4 are formed before the formation of the resistive element 5. Therefore, when the chip resistor 1 is to be manufactured, the process for forming the second electrode layers 6 can be started after judging whether an initial resistance value prevailing before the formation of the trimming groove 5*a* is appropriate. Consequently, if the initial resistance value is judged to be inappropriate, there is no need to form the second electrode layers 6. It provides an advantage in that the associated electrode material can be saved accordingly.

Further, according to the present embodiment, the chip resistor 1 has the two-layer structure in which the first electrode layers 4 differ from the second electrode layers 6 in size and shape. More specifically, the square-shaped second electrode layers 6 are larger than the trapezoidal first electrode layers 4 so that the first and second electrode layers 4, 6 are closely attached to the ceramic substrate 2. This makes it possible to properly prevent the electrode layers 4, 6 from separating from each other at the time, for instance, of baking.

Alternatively, however, the first and second electrode layers 4, 6 may be equally sized to overlap with each other and form a two-layer structure.

EXPLANATION OF REFERENCE NUMERALS

Figure 1:
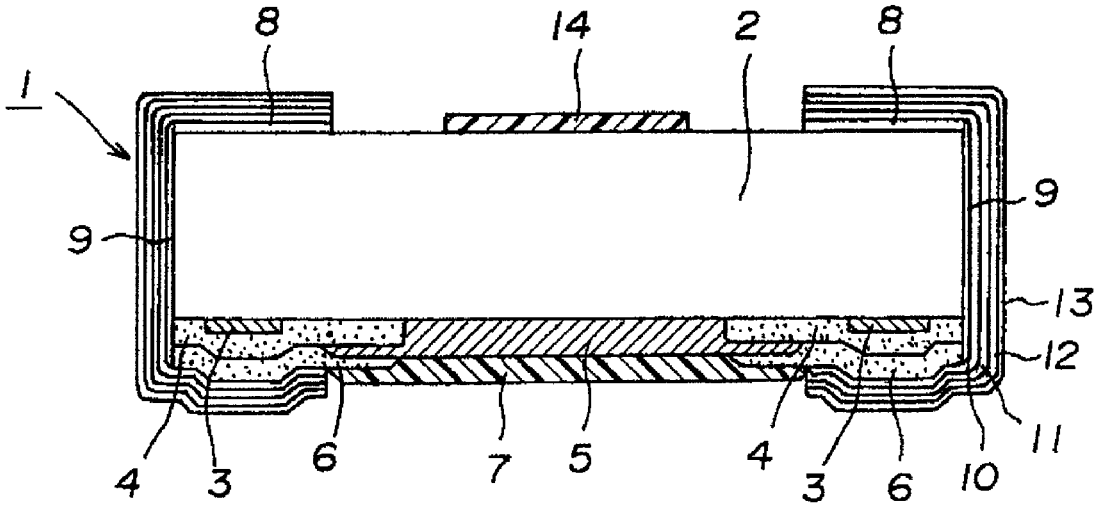
FIG. 1 is a cross-sectional schematic view illustrating a chip resistor according to an embodiment of the present invention.
Figure 2:
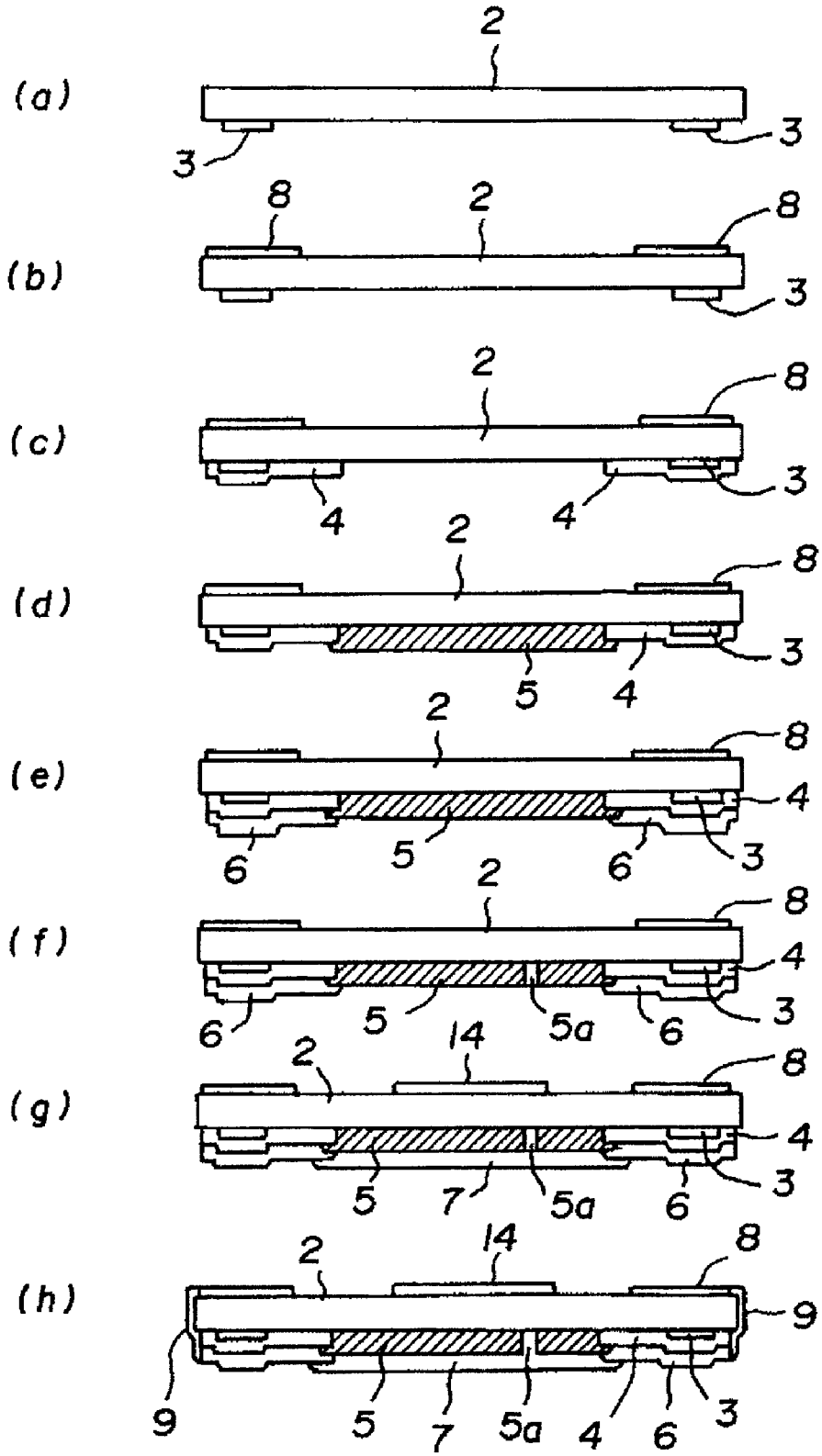
FIG. 2 is a cross-sectional views illustrating a manufacturing process for the chip resistor.
Figure 3:
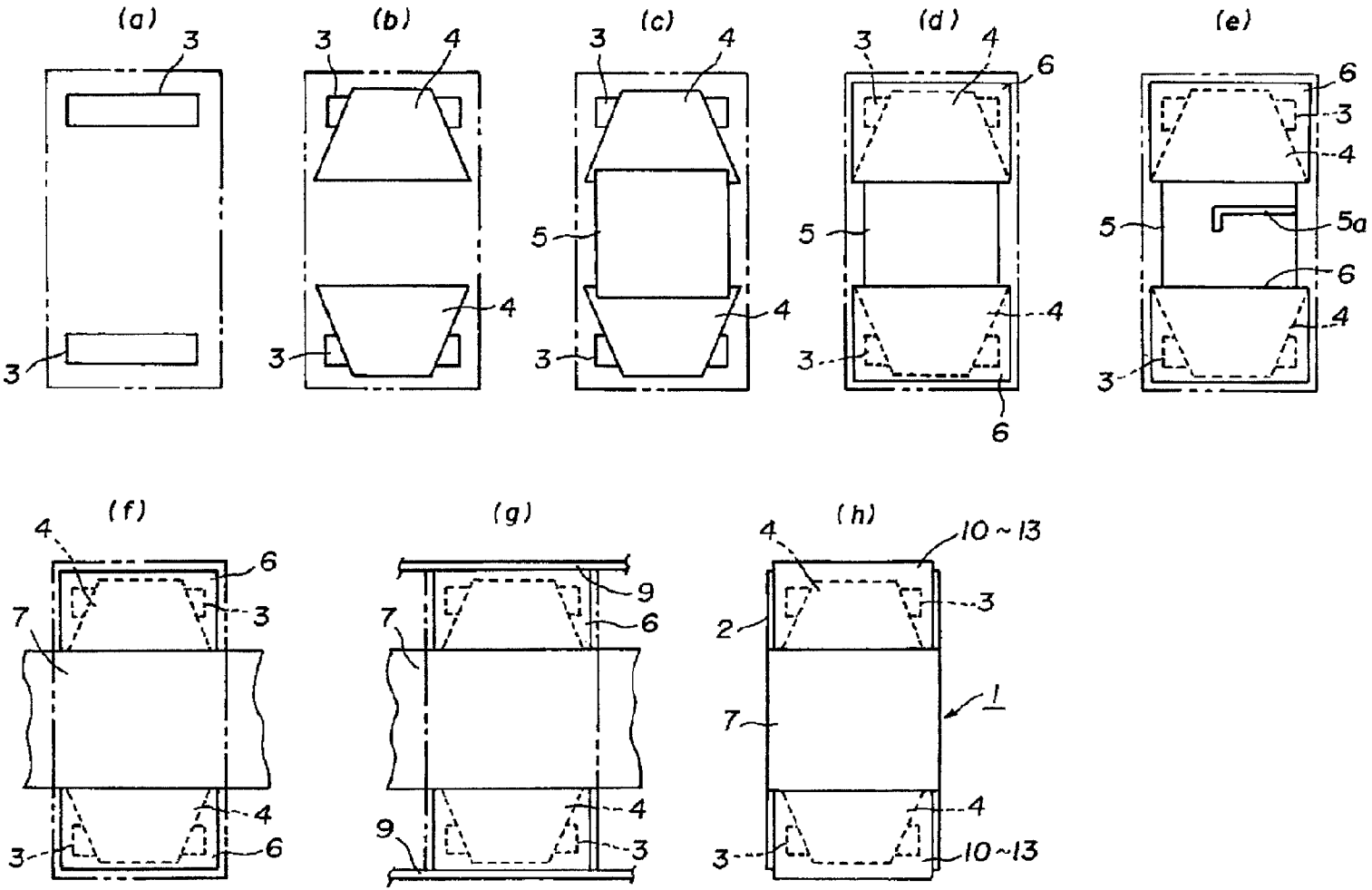
FIG. 3 is a plan views illustrating a manufacturing process for the chip resistor.
Figure 4:
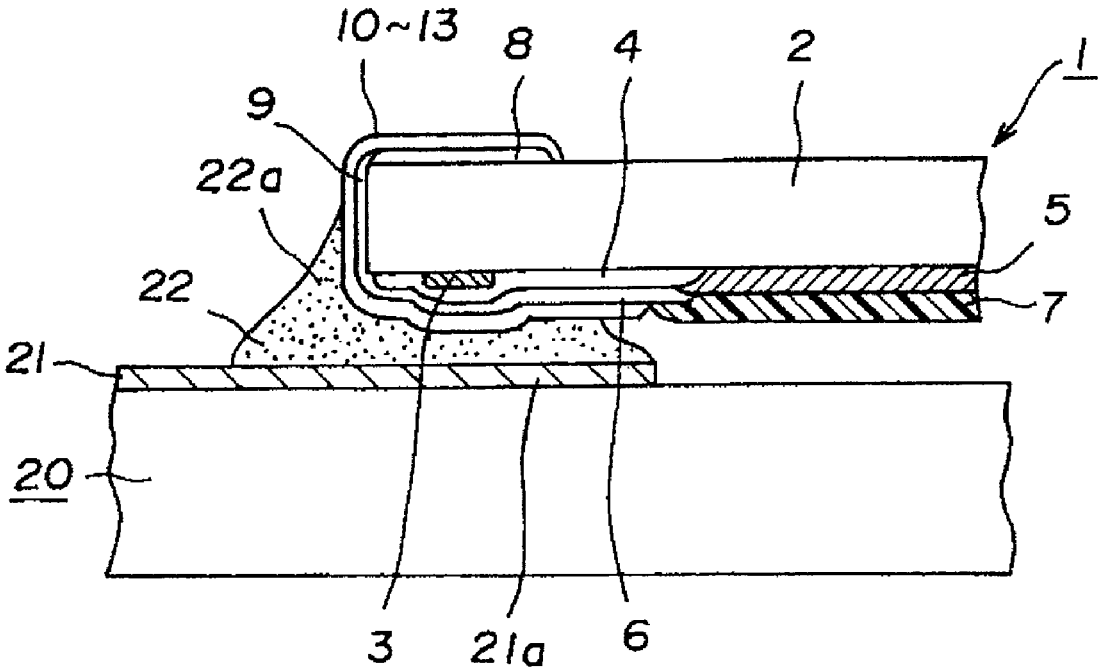
FIG. 4 is a cross-sectional view illustrating an essential part of the chip resistor mounted on a circuit board.

1: Chip resistor
2: Ceramic substrate
3: Bank-raising foundation section
4: First electrode layer
5: Resistive element
5*a*: Trimming groove
6: Second electrode layer
7: Protective layer
8: Upper electrode
9: End-face electrode
10-13: Plating layer
20: Circuit board
21: Wiring pattern
21*a*: Solder land
22: Solder
22*a*: Solder fillet

The invention claimed is:

1. A chip resistor comprising:

a ceramic substrate shaped like a rectangular parallelepiped;

a pair of bank-raising foundation sections that are made mainly of glass and positioned on both longitudinal ends of the lower surface of the ceramic substrate;

a pair of first electrode layers that are provided in regions covering at least parts of the bank-raising foundation sections and positioned at a predetermined distance from each other;

a resistive element that is made mainly of copper and positioned in a region bridging the first electrode layers;

a pair of second electrode layers that are positioned in regions covering the first electrode layers;

an insulating protective layer that covers the resistive element exposed between the second electrode layers;

a pair of end-face electrodes that are positioned on both longitudinal end faces of the ceramic substrate with the lower ends closely attached to the second electrode layers; and a plating layer that covers the second electrode layers and the end-face electrodes;

wherein the plating layer is soldered to a wiring pattern on a circuit board with the first and second electrode layers positioned on the wiring pattern to mount the chip resistor on the circuit board.

2. The chip resistor according to claim 1, wherein the second electrode layers are larger than the first electrode layers and parts of the second electrode layers are closely attached to the lower surface of the ceramic substrate.

* * * * *